United States Patent [19]

Zusatz

[11] 4,006,773

[45] Feb. 8, 1977

[54] CENTRIFUGALLY CASTING MACHINE HAVING AN AXIAL SUPPORT DEVICE

[75] Inventor: François Zusatz, Pont-a-Mousson, France

[73] Assignee: Pont-A-Mousson S.A., Nancy, France

[22] Filed: May 3, 1976

[21] Appl. No.: 682,536

[30] Foreign Application Priority Data

June 18, 1975 France ..... 75.19037

[52] U.S. Cl. ..... 164/298; 425/435

[51] Int. Cl.[2] ..... B22D 13/02

[58] Field of Search ..... 164/114, 298, 299, 300, 164/301; 425/435

[56] References Cited

UNITED STATES PATENTS 1,831,310 11/1931 Lindemuth ..... 164/114 X

*Primary Examiner*—Robert D. Baldwin

*Attorney, Agent, or Firm*—Sughrue, Rothwell, Mion, Zinn & Macpeak

[57] ABSTRACT

In a centrifugal casting machine, the mould carries a ring having a groove defining two spaced-apart annular non-axially extending bearing surfaces. The fixed frame of the machine carries a fixed journal perpendicular to the axis of rotation of the mould and contained in the plane containing the axis of rotation of the mould. A lever perpendicular to the journal is pivotably mounted on the journal and carries two support rollers freely rotatable on the lever. The axes of the journal and the support rollers are in the same plane and parallel to each other. The rollers taper to the axis of rotation of the mould and the two annular surfaces have the same taper as the rollers. The axial distance between the two annular surfaces of the ring allows the lever to pivot about the journal so that both rollers are always in contact with one of the annular bearing surfaces.

3 Claims, 6 Drawing Figures

CENTRIFUGALLY CASTING MACHINE HAVING AN AXIAL SUPPORT DEVICE

The present invention relates to machines of the type comprising a fixed frame with respect to which a case of revolution is mounted to be rotatable about its axis, said case being provided with an axial support device operative in one or the other direction and comprising a ring disposed in a plane perpendicular to the axis and integral with the case and at least one support roller mounted on the frame so as to be capable of rolling on a non-axial face of said ring.

This invention is particularly advantageous in machines for the centrifugal casting of pipes having a socket, in which machines the rotating case of revolution is constituted by the centrifugal casting mould itself.

It is known that centrifugal casting moulds which are rotatably mounted on support rollers are subjected to axial loads or thrusts in one or the other direction: in a direction from the male end to the socket when extracting the cast pipe, and in the direction from the socket to the male end, either when placing in position and blocking a socket core on the head of the mould, or under the force exerted by an automatic mounting and supporting arm for a core which must resist the axial thrust exerted by the iron cast on this core.

If any longitudinal movement of the mould under the effect of these axial forces is prevented, deformations of the mould occur, the latter undergoing buckling stresses which could greatly hinder a good and free rotation of the mould.

This is why, in order to resist these axial forces, there has already been provided, as mentioned hereinbefore, a thrust roller bearing against a ring integral with the mould and capable of rolling on the latter.

However, and especially in the case of centrifugal casting moulds of large diameter, that is to say for example of a diameter exceeding 600mm, it would then be necessary to employ a thrust roller of very large size. Now, the larger the thrust roller, the less sure one is of having a thrust support which is true and therefore effective throughout its generatrix of contact, owing to mould manufacturing tolerances which is usually in the as-cast state on the outside, and owing to the more or less regular rotation of the mould which rotates more or less true.

It could therefore be supposed that it would suffice to have two thrust rollers rolling on the same surface of the ring to solve the problem, the axial force being theoretically distributed between these two rollers. However, for the same reason as before, a real support on two generatrices of contact, one for each roller, would be an illusion. There would be rather a certainty of support on a single one of the rollers and this roller would not withstand the forces for a long time. Moreover, such an arrangement would result in a difficult alignment of the axes of the thrust rollers with those of the support rollers.

An object of the present invention is to provide a machine of the aforementioned type which has an effective and strong axial support.

According to the invention, there is provided a machine wherein the axial support device comprises a journal which is integral with the frame and disposed radially with respect to the case in the normal position of the mean plane of the ring, and on which journal there is mounted to be freely rotatable and perpendicularly thereto a lever which carries two thrust rollers whose axes are contained in the plane of the axis of the journal and of the axis of the lever and which are freely rotatably mounted on the lever, the ring having two non-axial bearing surfaces between which bearing surfaces the rollers are located, the distance in the axial direction between the bearing surfaces allowing the lever to move angularly.

Owing to this simple and strong structure, not only are the two thrust rollers at the same time constantly in a thrust position on the ring during the rotation of the case and thus exert an axial reaction against the forces and ensure a good distribution of the forces between the two rollers, but there is no longer any problem of the alignment of the thrust rollers with the support rollers.

Further features and advantages of the invention will be apparent from the ensuing description given by way of a non-limitative example, with reference to the accompanying drawing in which.

Figure 1:
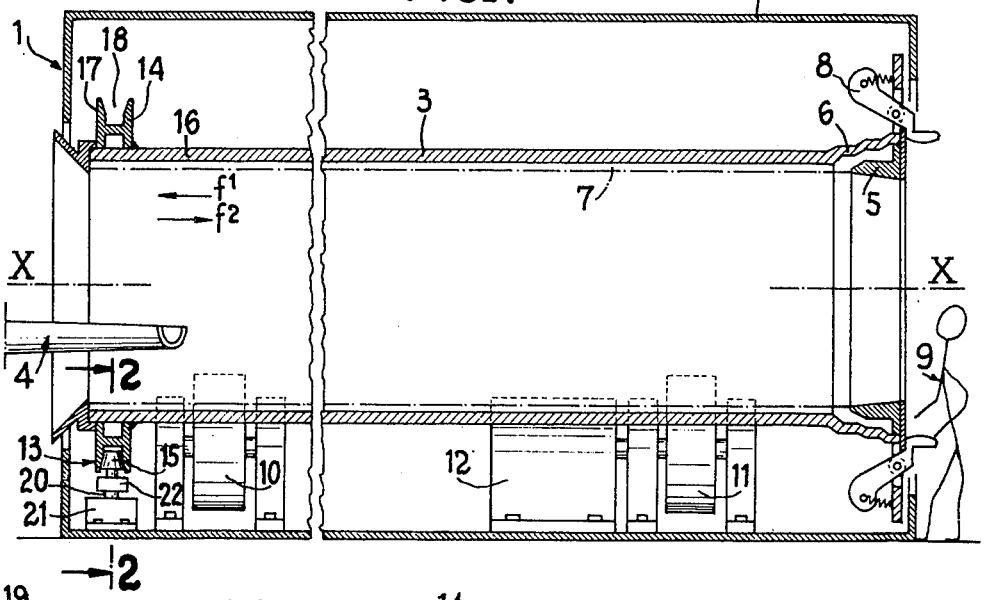
FIG. 1 is a diagrammatic elevational and diametral sectional view of a centrifugal casting machine according to the invention.
Figure 2:
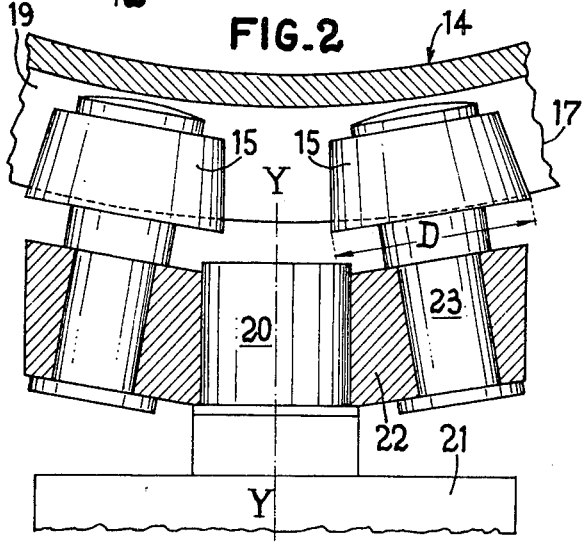
FIG. 2 is a partial cross-sectional view, to an enlarged scale, taken on line 2—2 of FIG. 1.
Figure 3:
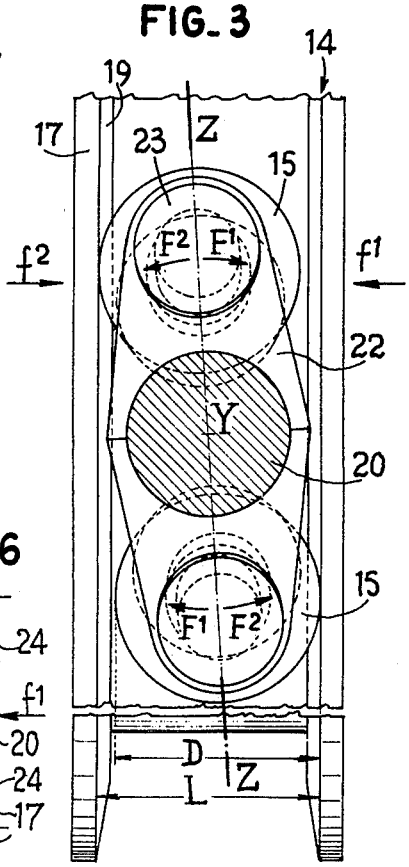
FIG. 3 is a view of the under side of the part shown in FIG. 2 which also shows the profile of the axial section of the ring.

The centrifugal casting machine 1 shown in the drawing comprises a case 2 in which there is mounted, to be rotatable about its horizontal axis, a mould 3 having a generally tubular shape whose end portion extends through apertures in the case 2. It concerns more precisely a machine of the de Lavaud type, that is to say a machine associated with a long pouring trough 4 which is shown partly and is adapted to travel longitudinally through the mould 3 so as to pour the molten iron therein, the case 1 being assumed here to be fixed in translation and the trough 4 movable in a direction parallel to the axis X—X. The mould 3 is completed by a core 5 which is fixed inside one enlarged end portion 6 of this mould and defines the inner shape of the socket of the pipe 7 to be cast, shown in dot-dash line, this core being maintained locked on the mould by a number of centrifugal keys 8. A human form 9 has been shown symbolically near to the machine in order to reveal that this core has roughly the size of a man. The mould bears on support rollers 10 and 11 having an axis parallel to the axis X—X, the rollers 11 being also driving rollers since they are driven in rotation by a motor 12.

The machine also has an axial support or thrust device 13 which comprises a ring 14 and two support or thrust rollers 15. The ring 14 is mounted on and secured to the male end portion 16 opposed to the socket end 6 of the mould 3 (but, by way of a modification, it could of course be fixed on this socket end 6) and it has two cheeks 17 which are interconnected by a cylindrical ring so as to form an annular groove 18 having a radially outwardly divergent frustoconical profile, the inner surfaces 19 of the cheeks having for this purpose a frustoconical shape of axis X—X. The axial support device further comprises a journal or pivot 20 which is fixed by a base 21 inside the case 2 on a vertical axis Y—Y intersecting the axis X—X and located, in the normal position, that is to say, in the absence of axial loads on the mould, of the plane of symmetry of the ring 14. Freely pivotably mounted on the journal 20 is a support lever 22 which is substantially horizontal and has an axis Z—Z which is oriented on average in a direction perpendicular to the axes X—X and Y—Y, that is to say, a direction which is transverse to the mould. At its ends and symmetrically with respect to the axis Y—Y, the lever 22 carries two journals 23 whose axes are slightly inclined in the plane Y–Z so as to converge to the axis X—X and on each of these journals one of the two rollers 15 is freely rotatable.

The space between the journals 23 is relatively small, such, for example, that the angle between their axes be of the order of only 20°. The two rollers 15 have a frustoconical shape whose axis is the axis of the journals 23 and whose conicity is complementary to the conicity of the surfaces 19 of the cheeks of the ring so as to be capable of cóoperating with these surfaces. The large base of these rollers, which faces radially outwardly of the mould, has a diameter D slightly less, for example by 5 to 10%, than the maximum width L of the groove 18 of the ring in the axial direction of the mould. Thus the pivotable lever 22 is capable of moving angularly to a relatively small extent, for example of the order of 5°, about the journal 20, this movement being limited by the cheeks 17 of the ring 14.

The machine and the axial support device just described operate in the following manner:

When the mould 3 is stationary, the rollers 16 engaged in the ring 14 may be indifferently in contact with the surfaces 19 of the cheeks 17 or slightly spaced away from these surfaces, the lever 22 being in a position of rest.

When the mould 3 is driven in rotation before casting, when introducing and fixing the core 5, this mould undergoes an axial thrust in the direction of arrow $f^1$ (from the socket toward the male end). This axial thrust is produced by an arm which brings the core into position and could even be maintained by the same arm (not shown) if it was the means employed for locking the core instead of the keys 18 employed in the presently-described embodiment. If the journal 20 of axis Y—Y was located strictly in the plane of symmetry of the ring, at equal distances from its cheeks, if the mould rotated perfectly true and if the cheeks of the ring were perfectly circular, the cheeks 17 located adjacent the socket 6 would bear perfectly on the generatrices of the two rollers located on the same side of the axis Z—Z of the arm 22 and the latter would not pivot. If on the other hand the cheeks of the ring 14 are greatly deformed, for example owing to the frequent assemblies and dis-assemblies of the mould 3, it could happen that the cheek 17 which is the nearer to the socket is the first to bear against a single one of the rollers, for example that located at the top in FIG. 4, but it could be the other roller. The lever 22 pivots then about the journal 20 and the roller 17 at the bottom of FIG. 4 then abuts the other cheek located adjacent the male end. There is in this way a contact on the generatrices 24 of the rollers which are opposed with respect to the axis Z—Z of the lever 22. It could also happen that it is the cheek 17 which is the nearer to the male end 16 which is the first to come in contact with one of the rollers owing to the fact that the mould rotates out of true or that the cheek has an irregular shape. In this case the lever 22 pivots in the opposite direction.

Figure 5:
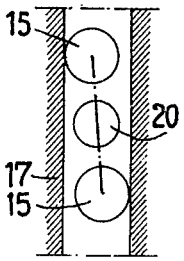
FIGS. 4, 5 and 6 are diagrams corresponding to FIG. 3 and illustrating the operation of the machine.
Figure 4:
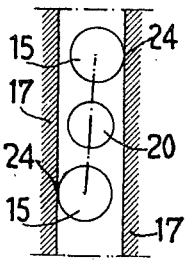

In normal operation, the lever 22 which has a certain degree of freedom illustrated in FIGS. 4 and 5 pivots either in one direction or in the opposite direction under the effect of the aforementioned unevennesses or irregularities, of the axial expansion of the mould and of the axial displacements of the mould.

Figure 6:
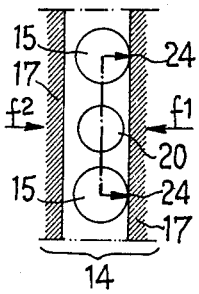

During the rotation of the mould and during the casting, this mould undergoes an axial thrust exerted by the cast iron reaching the core and a higher axial counter-thrust for locking exerted by the keys 8 or the arm for supporting and locking the core (FIG. 6). The mould (FIG. 6) always remains in abutment, by the cheeks 17 of the ring 14, with the rollers 15 on two generatrices of contact 24 (FIG. 6). One of these rollers exerts an axial thrust reaction against one cheek 17 whereas the other roller exerts a parallel-axial reaction on the same cheek. The two axial reactions of the rollers are equal and in the same direction and pass through the generatrices of contact 24 and balance the thrust $f_1$ of the mould.

When extracting the pipe 7 just cast, the mould undergoes an axial tensile force in the direction of arrow $f_2$.

The advantages of the machine equipped with this axial support device are the following among others:

Owing to the lever and the two rollers cooperating with the ring having frustoconical cheeks, notwithstanding the imperfections in the fitting of the device when mounting, notwithstanding the imperfections of rotation of the mould (rotating out of true resulting from severe thermic stresses due to the heating and cooling of the mould), notwithstanding possible deformations of the cheeks of the ring and notwithstanding the wear of the parts in contact, a contact of the two rollers on the cheeks always occurs on two generatrices of contact. Consequently, the axial force to which the device is subjected is perfectly and equally distributed between the two rollers which are capable of withstanding it, whence a reduction by one half of the wear due to the specific pressure of contact. Owing to the lever 22, the couple of axial reactions is perfectly balanced. Without this lever, the use of two thrust rollers mounted on fixed journals would be an illusion, since a single one of the rollers would in fact support the whole of the axial load and would not last long.

Having now described my invention what I claim as new and desire to secure by Letters Patent is:

1. A machine, in particular for centrifugal casting, comprising a fixed frame, a case of revolution mounted relative to the frame to be rotatable about the axis of the case, an axial device operative in either direction for axially supporting the case and comprising a ring contained in a plane perpendicular to said axis and integral with the case, a journal which is integral with the frame and has an axis disposed radially with respect to the case in the normal position of the mean plane of the ring, a lever mounted on the journal and having an axis perpendicular to the journal and freely rotatable relative to the journal, two support rollers having axes of rotation contained in a plane containing the axis of the journal and the axis of the lever and mounted to be freely rotatable on the lever, the ring defining two main annular non-axially extending bearing surfaces between which surfaces the rollers are located, the distance between the bearing surfaces in the axial direction allowing an angular movement of the lever.

2. A machine as claimed in claim 1, wherein the rollers are disposed on the lever symmetrically on each side of the journal.

3. A machine as claimed in claim 1, wherein the rollers are frustoconical with their axes converging to the axis of the case, and the ring has a groove having a trapezoidal axial section defining said two bearing surfaces which have the same inclination as the generatrices of the rollers.

* * * * *